US008963980B2

(12) United States Patent
Kobayashi

(10) Patent No.: US 8,963,980 B2
(45) Date of Patent: Feb. 24, 2015

(54) IMAGE FORMING APPARATUS AND IMAGE FORMING METHOD

(75) Inventor: Takakazu Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/600,602

(22) Filed: Aug. 31, 2012

(65) Prior Publication Data

US 2013/0242029 A1 Sep. 19, 2013

(30) Foreign Application Priority Data

Mar. 19, 2012 (JP) ..... 2012-062544

(51) Int. Cl.

| | |
|---|---|
| ***B41J 2/385*** | (2006.01) |
| ***B41J 2/41*** | (2006.01) |
| ***B41J 2/435*** | (2006.01) |
| ***B41J 2/47*** | (2006.01) |

(52) U.S. Cl.

USPC ..... 347/252; 347/130; 347/131; 347/254

(58) Field of Classification Search

CPC ..... B41J 2/385; B41J 2/41; B41J 2/435; B41J 2/47

USPC ..... 347/111, 112, 129, 130, 131, 224, 225, 347/251, 252, 254

See application file for complete search history.

(56) References Cited

U.S. PATENT DOCUMENTS

| | | | | |
|---|---|---|---|---|
| 2002/0130947 | A1* | 9/2002 | Okumura et al. | 347/240 |
| 2007/0120939 | A1* | 5/2007 | Arai et al. | 347/132 |
| 2008/0003003 | A1* | 1/2008 | Watanabe et al. | 399/49 |

FOREIGN PATENT DOCUMENTS

| | | | |
|---|---|---|---|
| JP | 2006-154072 | A | 6/2006 |
| JP | 2009-015003 | A | 1/2009 |

* cited by examiner

*Primary Examiner* — Justin Seo
*Assistant Examiner* — Kendrick Liu
(74) *Attorney, Agent, or Firm* — Sughrue Mion, PLLC

(57) ABSTRACT

An image forming apparatus includes an image information retrieval unit that retrieves image information of an image to be formed on a recording material, a density information retrieval unit that retrieves information relating to an image density of the image to be formed in accordance with the image information through analysis of the image information retrieved by the image information retrieval unit, an exposure unit that exposes a rotating image carrier to light in response to the image information retrieved by the image information retrieval unit, and a setting unit that sets, in accordance with the information relating to the image density retrieved by the density information retrieval unit, an exposure period according to which the exposure unit exposes the rotating image carrier to light.

17 Claims, 8 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2012-062544 filed Mar. 19, 2012.

BACKGROUND

Technical Field

The present invention relates to an image forming apparatus and an image forming method.

SUMMARY

According to an aspect of the invention, an image forming apparatus is provided. An image forming apparatus includes an image information retrieval unit that retrieves image information of an image to be formed on a recording material, a density information retrieval unit that retrieves information relating to an image density of the image to be formed in accordance with the image information through analysis of the image information retrieved by the image information retrieval unit, an exposure unit that exposes a rotating image carrier to light in response to the image information retrieved by the image information retrieval unit, and a setting unit that sets, in accordance with the information relating to the image density retrieved by the density information retrieval unit, an exposure period according to which the exposure unit exposes the rotating image carrier to light.

BRIEF DESCRIPTION OF THE DRAWINGS

Exemplary embodiments of the present invention will be described in detail based on the following figures, wherein.

DETAILED DESCRIPTION

First Exemplary Embodiment

A first embodiment of the present invention is described below with reference to the drawings.

Figure 1:
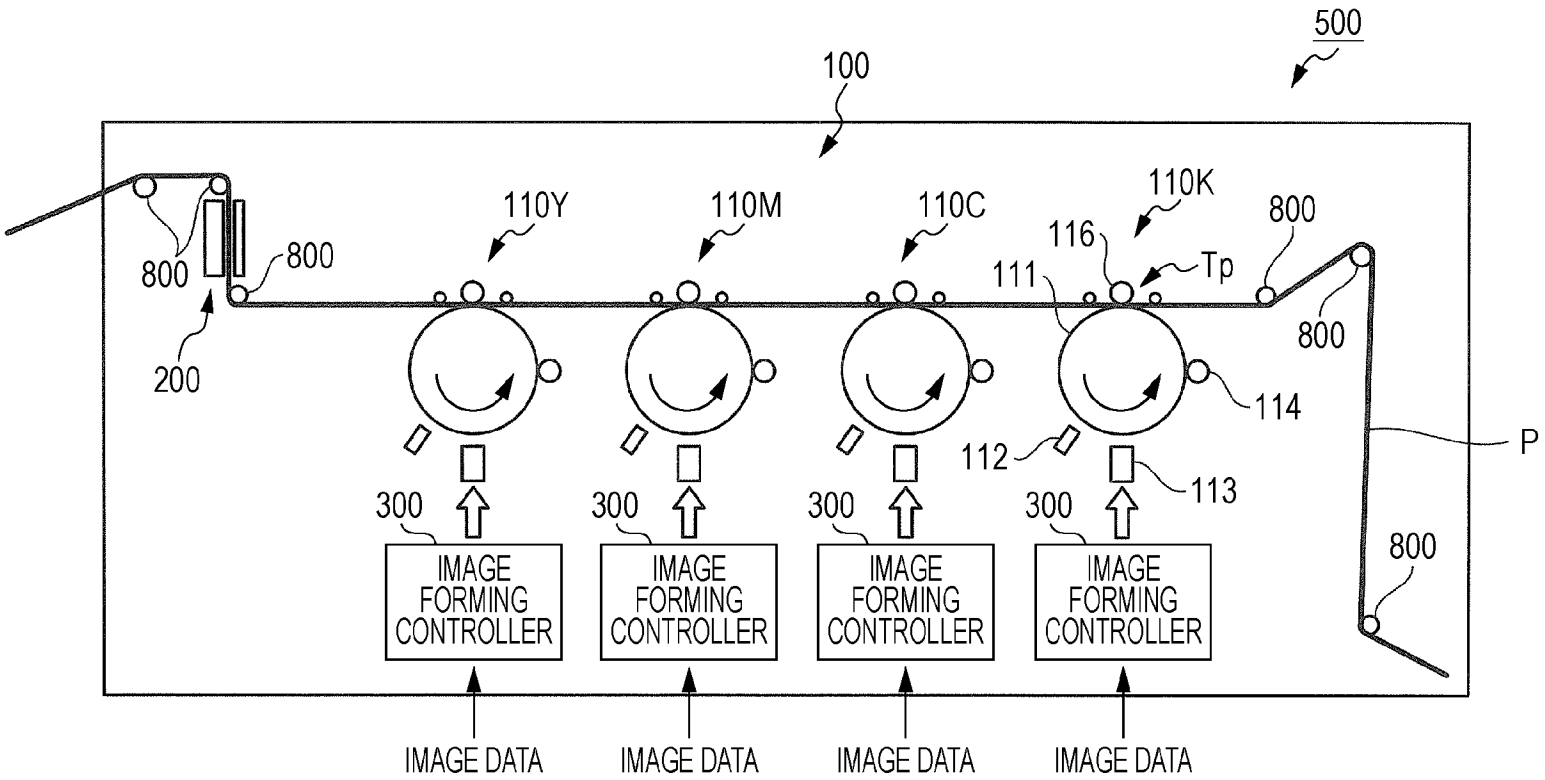
FIG. 1 illustrates an image forming apparatus of a first exemplary embodiment of the invention.

FIG. 1 illustrates an image forming apparatus 500 of the first embodiment. As illustrated in FIG. 1, the image forming apparatus 500 includes an image forming assembly 100 including four image forming units 110Y, 110M, 110C, and 110K. The image forming assembly 100 forms a toner image on a continuous paper sheet P as an example of a recording material. The image forming apparatus 500 also includes a fixing device 200 that fixes the image formed by the image forming assembly 100 onto the continuous paper sheet P. The image forming apparatus 500 further includes multiple supporting rolls 800. The supporting rolls slidably support the continuous paper sheet P that is transported in the image forming apparatus 500 in a manner such that the continuous paper sheet P is kept tensioned.

The fixing device 200 fuses toner by emitting flash light, thereby fixing an image (toner image) onto the continuous paper sheet P. The image forming apparatus 500 also include image forming controllers 300 respectively corresponding to the four image forming units 110Y, 110M, 110C, and 110K. The image forming controllers 300 control the respective image forming units 110Y, 110M, 110C, and 110K.

The image forming assembly 100 electrophotographically forms one color image after another in a tandem method. The image forming assembly 100 includes the four image forming units 110Y, 110M, 110C, and 110K as described above. The image forming unit 110Y forms a toner image of yellow (Y) color on the continuous paper sheet P, and the image forming unit 110M forms a toner image of magenta (M) color on the continuous paper sheet P. The image forming unit 110C forms a toner image of cyan (C) color on the continuous paper sheet P, and the image forming unit 110K forms a toner image of black (K) on the continuous paper sheet P.

According to the first exemplary embodiment, the four image forming units 110Y, 110M, 110C, and 110K respectively include electrophotographic devices. The image forming unit 110K is described, for example. The image forming unit 110K include a photoconductor drum 111 as an example of an image carrier that rotates in a direction denoted by an arrow, a charging device 112 that functions as a charging unit to electrostatically charge the photoconductor drum 111. A light-emitting diode (LED) print head 113 is arranged downstream of the charging device 112 in the rotation direction of the photoconductor drum 111 and extends in the axial direction of the photoconductor drum 111. The LED print head 113 forms an electrostatic latent image on the photoconductor drum 111. A development device 114 is arranged downstream of the LED print head 113 in the rotation direction of the photoconductor drum 111. The development device 114 serving a development unit that develops a visible image using toner in accordance with the electrostatic latent image.

The image forming unit 110K includes a transfer roll 116 functioning as a transfer unit. The transfer roll 116 transfers a toner image formed on the photoconductor drum 111 (the toner image held by the photoconductor drum 111) to the continuous paper sheet P at a transfer section Tp. According to the first exemplary embodiment, the toner image is directly transferred from the photoconductor drum 111 to the continuous paper sheet P. Optionally, a transfer member such as an intermediate transfer body is arranged between the photoconductor drum 111 and the continuous paper sheet P, and the toner image is transferred to the continuous paper sheet P via the transfer member. Each of the image forming units 110Y, 110M, and 110C is identical in structure to the image forming unit 110K. The image forming units 110Y, 110M, and 110C respectively include the photoconductor drums 111 and other elements.

The image forming apparatus 500 includes a general controller (not illustrated). The general controller retrieves image data (image information) and control information transmitted from a host apparatus at a hierarchically upper position, and then outputs these pieces of information to each of the image forming controllers 300. More specifically, the general controller retrieves page description language (PDL) data from the host apparatus, and converts the PDL data into raster data (page data). The general controller performs, on the raster data, image processes including color conversion, and then outputs to the respective image forming controllers 300 image data (raster data, and color gradation data of four Y, M, C, and K colors) resulting from performing the image processes.

Each image forming controller 300 performs on/off control on each LED element arranged in the LED print head 113 in accordance with the image data transmitted from the general controller, thereby forming the electrostatic latent image on the respective photoconductor drum 111 in accordance with the image data. According to the first exemplary embodiment, the surface of the photoconductor drum 111 is charged at a potential predetermined by the charging device 112, and then exposed to light by the LED print head 113. The electrostatic latent image results on the photoconductor drum 111.

The toner image is developed on the photoconductor drum 111 by the development device 114 and is then transferred to the continuous paper sheet P at the transfer section Tp where the photoconductor drum 111 and the transfer roll 116 are opposed to each other. The continuous paper sheet P having the toner image transferred thereto is then transported to the fixing device 200 where the toner image is fixed onto the continuous paper sheet P. The continuous paper sheet P successively passes through the image forming unit 110K, the image forming unit 110C, the image forming unit 110M, and then the image forming unit 110Y in that order. The toner image of K color, the toner image of C color, the toner image of M color, and the toner image of Y color are successively superimposed on the continuous paper sheet P.

Figure 2:
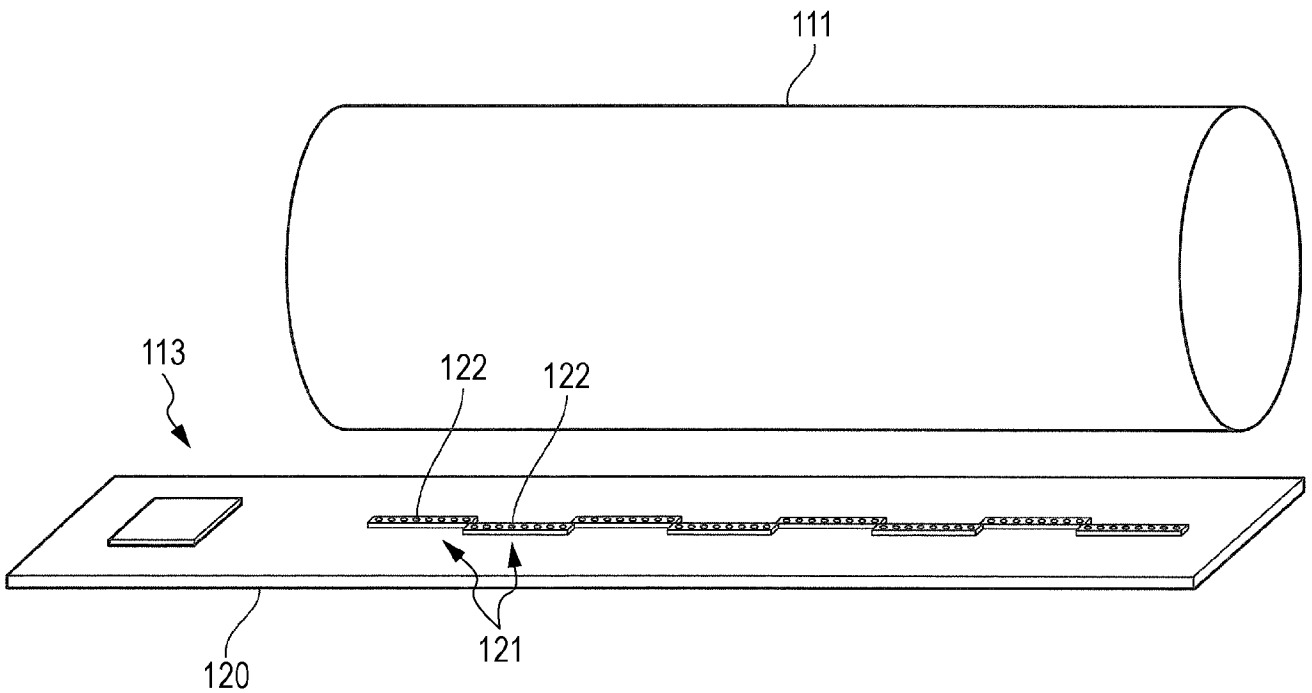
FIG. 2 illustrates a light-emitting diode (LED) head.

FIG. 2 illustrates the LED print head 113.

The LED print head 113 functioning as part of the exposure unit extends in the axial direction of the photoconductor drum 111 and exposes the photoconductor drum 111 to light. Arranged between the LED print head 113 and the photoconductor drum 111 is a rod lens array (not illustrated). The rod lens array focuses light from the LED print head 113 on the surface of the photoconductor drum 111.

The LED print head 113 includes a board 120. The board 120 includes multiple light-emitting chips 121, each chip 121 including a line of multiple light-emitting elements 122. The multiple light-emitting chips 121 are chained in a partially and mutually side lapping form in the axial direction of the photoconductor drum 111. The light-emitting element 122 is a light-emitting diode. According to the first exemplary embodiment, the LED print head 113 performs an exposure operation on the photoconductor drum 111 on a line-by-line basis in the axial direction of the photoconductor drum 111 (first scan direction). The electrostatic latent image is thus formed on one line at a time on the photoconductor drum 111.

Figure 3:
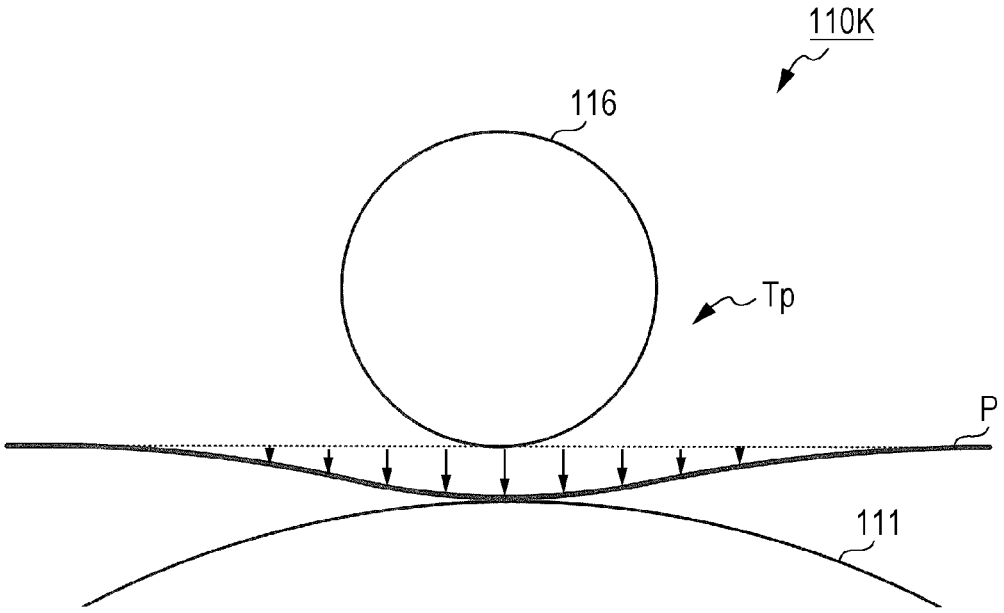
FIG. 3 illustrates in enlargement a transfer section including a photoconductor drum arranged on an image forming unit, and a transfer roll.

FIG. 3 illustrates in enlargement the transfer section Tp including the photoconductor drum 111 arranged on the image forming unit 110K, and the transfer roll 116. A phenomenon occurring on the image forming unit 110K is described here, but a similar phenomenon occurs on each of the image forming units 110M, 110C, and 110Y.

When the continuous paper sheet P passes between the photoconductor drum 111 and the transfer roll 116 in the first exemplary embodiment, the toner on the photoconductor drum 111 is transferred to the continuous paper sheet P, and the toner image is formed on the continuous paper sheet P. The higher the image density of the toner image formed on the photoconductor drum 111 becomes in the exemplary embodiment, the more likely the continuous paper sheet P is attracted toward the photoconductor drum 111. The formation pitch of the toner image transferred onto the continuous paper sheet P tends to be lower than an original pitch of the toner image.

More specifically, as the image density of the toner image formed on the photoconductor drum 111 becomes higher, the formation pitch of the toner image transferred onto the continuous paper sheet P (the formation pitch of the toner image after being transferred to the continuous paper sheet P) becomes lower than the original formation pitch. Furthermore, if the image density of the toner image formed on the photoconductor drum 111 becomes higher, a spacing increases between one line of the toner image transferred to the continuous paper sheet P and another line of the toner image in a second scan direction (a transport direction of the continuous paper sheet P).

If such a phenomenon occurs, a formation position of an image may shift from an originally intended position. The phenomenon may also lead to a quality reduction of an image to be formed. Such a formation position shift in the first exemplary embodiment may cause a color shift. More specifically, if the formation position of the toner image to be transferred from the image forming unit 110K to the continuous paper sheet P is shifted, a position discrepancy occurs between the toner image formed by the image forming unit 110K and the toner images formed by the image forming units 110Y, 110M, and 110C. This position discrepancy leads to a color shift.

If the formed image has a high density, a process to increase a formation pitch of the toner image (a process to shorten an exposure period) is performed in the first exemplary embodiment so that the decreasing of the formation pitch of the transferred tone image is controlled (a shift in the formation position of the toner image is controlled). The process is described in detail below.

Figure 4:
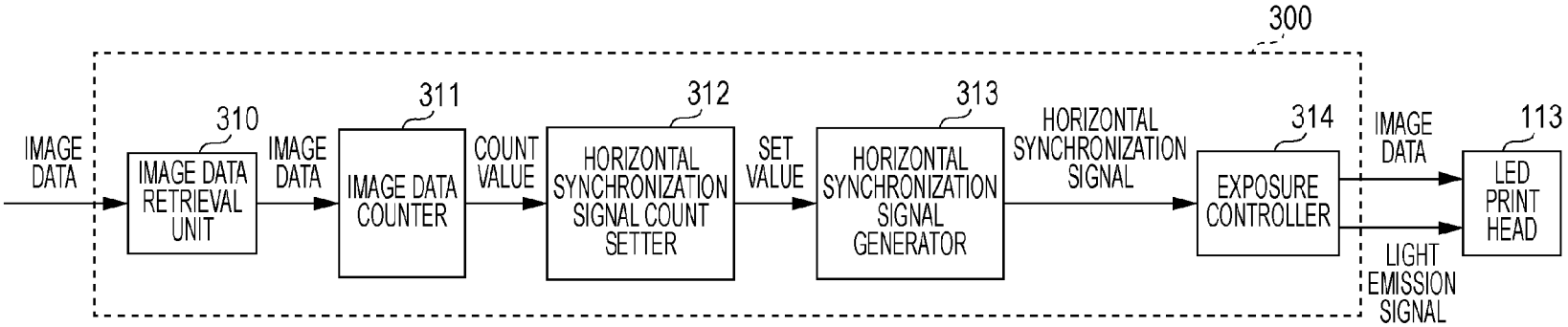
FIG. 4 illustrates an internal structure of an image forming controller arranged for the image forming unit.

FIG. 4 illustrates an internal structure of the image forming controller 300 arranged for the image forming unit 110K. The image forming controllers 300 respectively arranged for the image forming units 110Y, 110M, and 110C are identical in structure to the image forming controller 300 arranged for the image forming unit 110K.

As illustrated in FIG. 4, the image forming controller 300 includes image data retrieval unit 310, image data counter 311, horizontal synchronization signal count setter 312, horizontal synchronization signal generator 313, and exposure controller 314. Functions of the image data retrieval unit 310, the image data counter 311, the horizontal synchronization signal count setter 312, the horizontal synchronization signal generator 313, and the exposure controller 314 may be implemented using a dedicated circuit or by a program-controlled central processing unit (CPU).

The image data retrieval unit 310 serving as an example of an image information retrieval unit receives image data transmitted from the general controller. The image data counter 311 analyzes the image data received by the image data retrieval unit 310 on a line-by-line basis in the first scan direction, and counts the number of light-emitting elements 122 (see FIG. 2) lit (turned on) in the LED print head 113 on a line-by-line basis.

In other words, the image data counter 311 analyzes the image data on a line-by-line basis in the first scan direction, and learns the number of light-emitting elements 122 lit per line. The image data counter 311 serving as a density information retrieval unit analyzes the image data on a line-by-line basis in the first scan direction, and learns the number of light-emitting elements 122 lit per line on a line-by-line basis. The image data counter 311 thus retrieves the image density of the formed image based on one line of image data. The higher the count value retrieved by the image data counter 311 is, the higher the image density is. The lower the count value retrieved by the image data counter 311 is, the lower the image density is.

In response to the count value output from the image data counter 311, the horizontal synchronization signal count setter 312 sets an output timing of a horizontal synchronization signal serving as a start signal of exposure on each line. In other words, the horizontal synchronization signal count setter 312 serving as a setting unit sets an exposure period of exposure on each line (time interval) performed by the LED print head 113 in accordance with the count value output from the image data counter 311.

The horizontal synchronization signal generator 313 outputs the horizontal synchronization signal at the output timing set by the horizontal synchronization signal count setter 312. More specifically, the horizontal synchronization signal generator 313 outputs the horizontal synchronization signal each time it is the output timing set by the horizontal synchronization signal count setter 312. The exposure controller 314 outputs a light emission signal and image data to the LED print head 113 each time the exposure controller 314 receives the horizontal synchronization signal from the horizontal synchronization signal generator 313. With this arrangement, one line of the electrostatic latent image is formed on the photoconductor drum 111 each time the horizontal synchronization signal is output.

Figure 5:
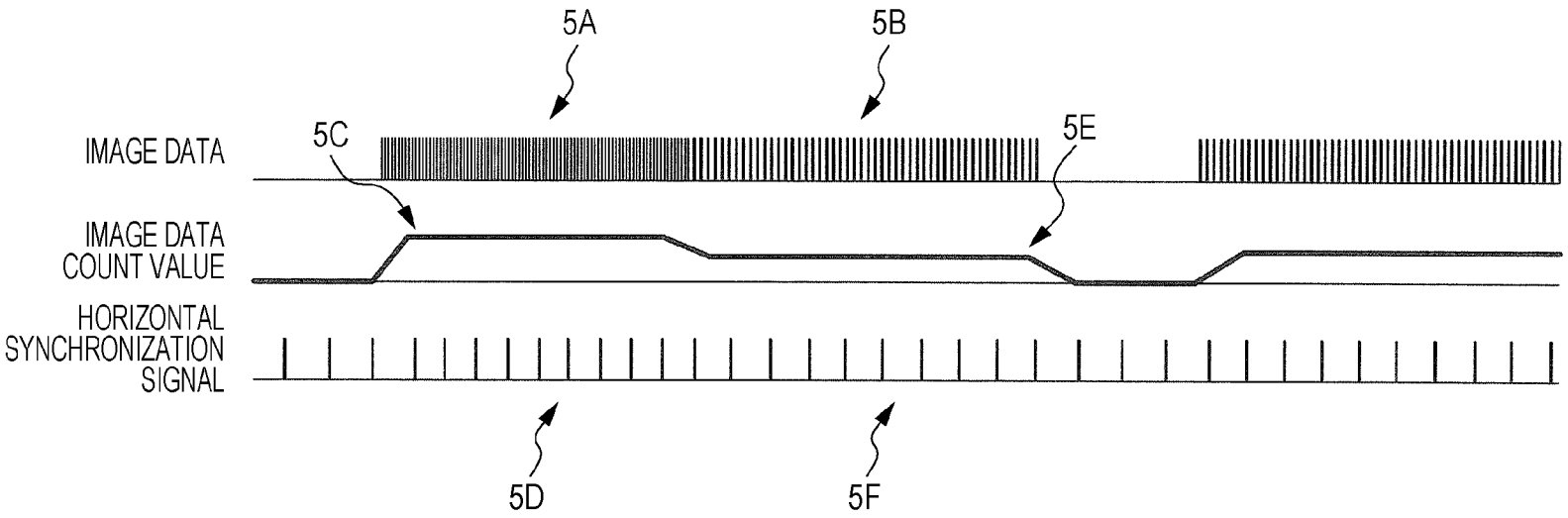
FIG. 5 illustrates a process executed by the image forming controller arranged for the image forming unit.

FIG. 5 illustrates a process performed by the image forming controller 300 arranged for the image forming unit 110K. "Image data" denoted by label 5A in FIG. 5 may include image data that give a solid image where the image density thereof is typically high. Image data denoted by label 5B may include image data that represent characters where the image density thereof is typically low. According to the first exemplary embodiment, the image data counter 311 analyzes the image data on a line-by-line basis, counts the number of light-emitting elements 122 lit on the LED print head 113, and retrieves the resulting count value.

If the count value denoted by label 5C is high (if the count value is higher than a predetermined value, or if an image density is higher than a predetermined image density), the horizontal synchronization signal count setter 312 advances the output timing of the horizontal synchronization signal. In other words, the horizontal synchronization signal count setter 312 shortens the output time intervals of the horizontal synchronization signal. The output time intervals of the horizontal synchronization signal actually output by the horizontal synchronization signal generator 313 are shortened as denoted by label 5D in FIG. 5. The horizontal synchronization signal count setter 312 controls an expansion in the spacing between one line of the image and a next line of the image in the second scan direction.

If the count value denoted by label 5E is low (if the count value is lower than the predetermined value, or if the image density is lower than the predetermined image density), the horizontal synchronization signal count setter 312 delays the output timing of the horizontal synchronization signal (in comparison with the case in which the count value is high). In other words, the horizontal synchronization signal count setter 312 lengthens the output time intervals of the horizontal synchronization signal. The output time intervals of the horizontal synchronization signal actually output by the horizontal synchronization signal generator 313 are lengthened as denoted by label 5F in FIG. 5.

If the count value becomes lower as denoted by label 5E in FIG. 5, the continuous paper sheet P is less likely to move toward the photoconductor drum 111 and the formation pitch of the toner image to be formed on the continuous paper sheet P becomes closer to the original formation pitch. If the horizontal synchronization signal is continuously output at the output intervals denoted by label 5D, the toner is formed on the continuous paper sheet P at a pitch higher than the original formation pitch. According to the exemplary embodiment, a process to delay the output timing of the horizontal synchronization signal (a process to shift the output timing of the horizontal synchronization signal to the original output timing) is performed if the count value becomes smaller as denoted by label 5E.

Second Exemplary Embodiment

Figure 6:
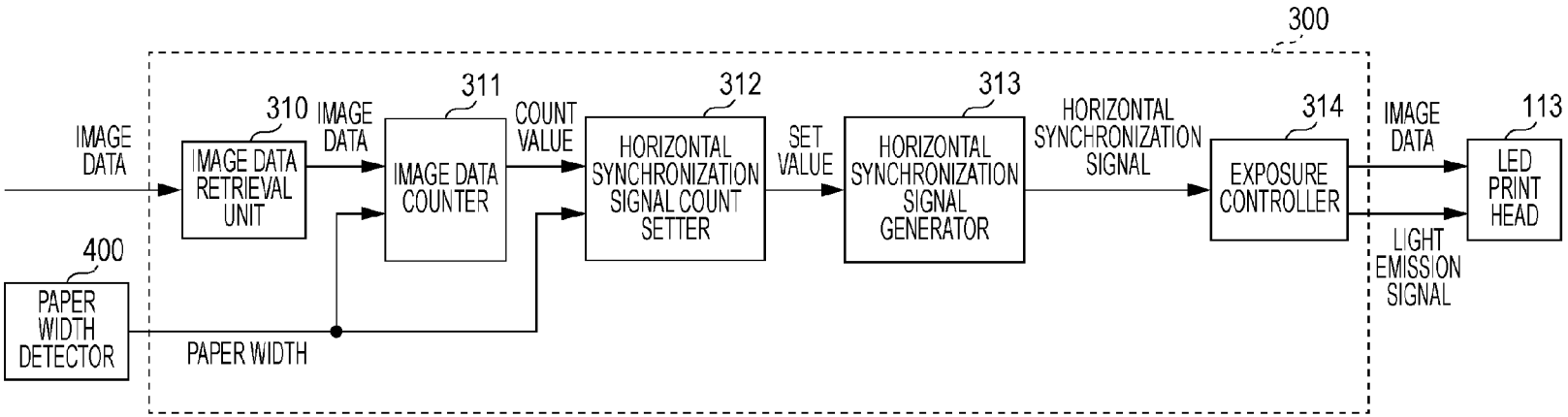
FIG. 6 illustrates a second exemplary embodiment of the image forming controller and other elements.

FIG. 6 illustrates the image forming controller 300 and other element as a second exemplary embodiment of the present invention. The image forming controller 300 and the other elements as the second exemplary embodiment of the present invention are described with reference to FIG. 6. Elements identical in function to those of the first exemplary embodiment are described with the same reference numerals and the discussion thereof are omitted herein. According to the second exemplary embodiment, information relating to a paper width of the continuous paper sheet P is output to the image data counter 311 from a paper width detector 400 that serves as a width information retrieval unit. The image data counter 311 counts the number of light-emitting elements 122 (see FIG. 2), within the paper width of the continuous paper sheet P, lit on the LED print head 113 on a line-by-line basis.

According to the first exemplary embodiment, the image data counter 311 counts the number of light-emitting elements 122 with respect to the total number of all the light-emitting elements 122 included in the LED print head 113. According to the second exemplary embodiment, on the other hand, the image data counter 311 counts the number of light-emitting elements 122 with respect to the light-emitting elements 122 actually contributing to the image formation. If the image forming assembly 100 transports a continuous paper sheet P narrower in width than the continuous paper sheet P having a maximum width that remains transportable by the image forming apparatus 500 of the second exemplary embodiment, not all the light-emitting elements 122 included in the LED print head 113 are used. The light-emitting elements 122 in the LED print head 113 are partially used. If the count value is retrieved with respect to all the light-emitting elements 122 as a total number, the image density is not accurately learned.

According to the second exemplary embodiment, the count value is retrieved with respect to as a total number the light-emitting elements 122 eligible to be actually lit (the light-emitting elements 122 that are targets of light controlling). The paper width detector 400 may recognize the paper width in response to the paper width input on a user interface (UI) (not illustrated) by a user. Alternatively, the paper width detector 400 may recognize the paper width in response to an output provided by a sensor (not illustrated) that senses a paper width.

Third Exemplary Embodiment

Figure 7:
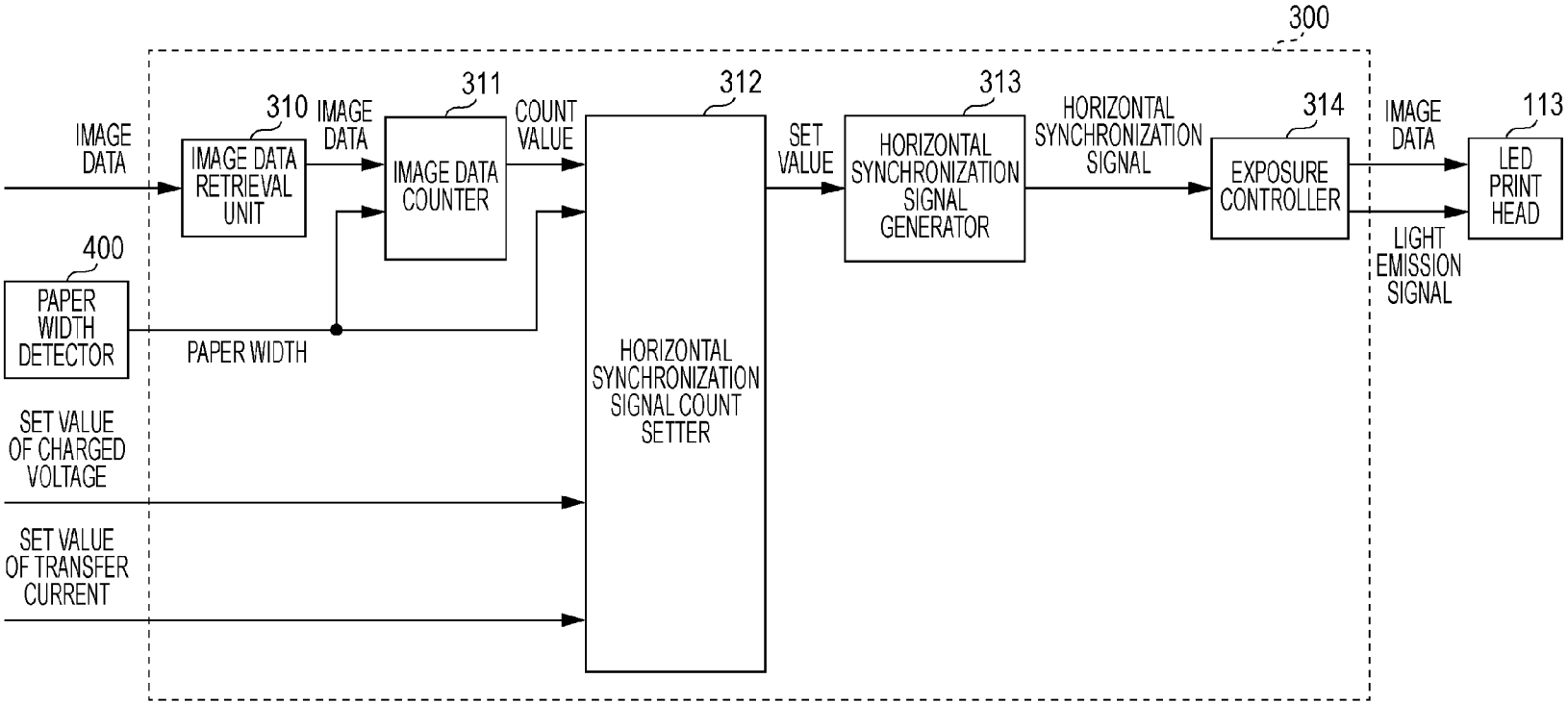
FIG. 7 illustrates a third exemplary embodiment of the image forming controller and other elements.

FIG. 7 illustrates the image forming controller 300 and other elements as a third exemplary embodiment of the present invention. The image forming controller 300 and the other elements as the third exemplary embodiment are described with reference to FIG. 7. Elements identical to those in the first and second exemplary embodiments are designated with the same reference numerals and the discussion thereof is omitted here.

According to the third embodiment, the horizontal synchronization signal count setter 312 receives a set value of a charged voltage of the charging device 112 (see FIG. 1) (hereinafter referred to as a "voltage set value") and a set value of a transfer current supplied to the transfer section Tp (see FIG. 1) (hereinafter referred to as a "current set value"). The horizontal synchronization signal count setter 312 sets the output timing of the horizontal synchronization signal that accounts for the information of the voltage set value and the current set value in addition to the information of the paper width.

A factor to decrease the formation pitch of the image (a factor to attract the continuous paper sheet P toward the photoconductor drum 111) includes the voltage set value and the current set value in addition to the image density on the photoconductor drum 111. The higher each of the voltage set value and the current set value is, the closer the continuous paper sheet P is attracted to the photoconductor drum 111, and the lower the formation pitch of the image on the continuous paper sheet P becomes.

According to the third exemplary embodiment, the voltage set value and the current set value are output to the horizontal synchronization signal count setter 312. The horizontal synchronization signal count setter 312 sets the output timing of the horizontal synchronization signal by accounting for the voltage set value and the current set value additionally. The output intervals of the horizontal synchronization signal are shortened in the third exemplary embodiment if each of the voltage set value and the current set value increases. The output intervals of the horizontal synchronization signal are lengthened if each of the voltage set value and the current set value decreases.

Fourth Exemplary Embodiment

Figure 8:
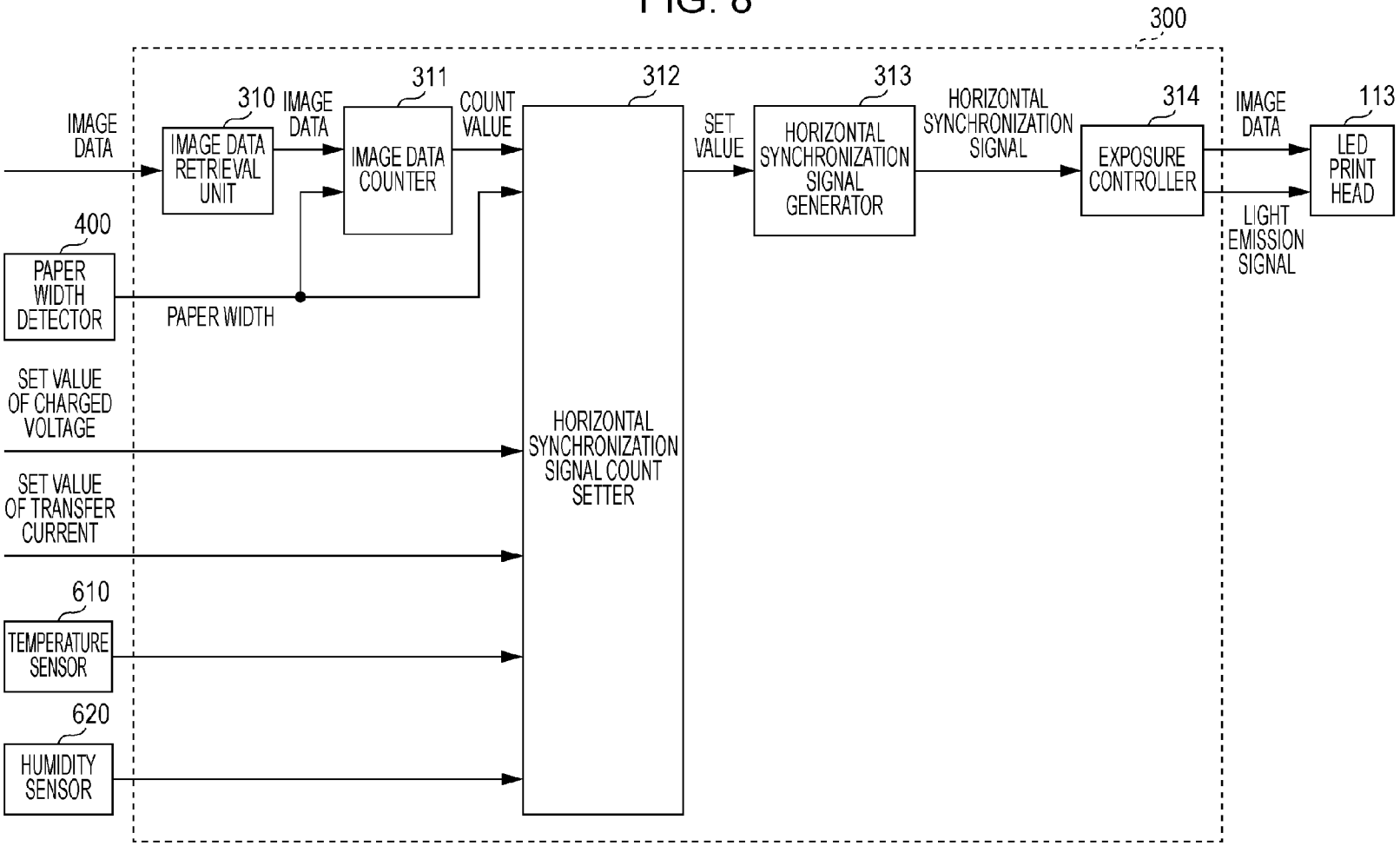
FIG. 8 illustrates a fourth exemplary embodiment of the image forming controller and other elements.

FIG. 8 illustrates the image forming controller 300 and other elements as a fourth exemplary embodiment of the present invention. The image forming controller 300 and the other elements as the fourth exemplary embodiment are described with reference to FIG. 8. Elements identical to those in the first through third exemplary embodiments are designated with the same reference numerals and the discussion thereof is omitted here.

According to the fourth exemplary embodiment, condition information relating to an internal condition of the image forming apparatus 500 is output to the horizontal synchronization signal count setter 312. More specifically, the image forming apparatus 500 includes a temperature sensor 610 and a humidity sensor 620, each sensor functioning as a condition information retrieval unit. The horizontal synchronization signal count setter 312 thus receives a detection result (temperature information) from the temperature sensor 610 and a detection result (humidity information) from the humidity sensor 620. The horizontal synchronization signal count setter 312 sets the output timing of the horizontal synchronization signal that accounts for the temperature information and the humidity information in addition to the count value, the paper width, the voltage set value, and the current set value.

The higher the humidity is, the more likely the continuous paper sheet P is attracted toward the photoconductor drum 111, and the lower the formation pitch of the image becomes. According to the fourth exemplary embodiment, the horizontal synchronization signal count setter 312 is supplied with the temperature information and the humidity information, and then sets the output timing of the horizontal synchronization signal that accounts for these pieces of information additionally. For example, in the fourth exemplary embodiment, if humidity is high, the output intervals of the horizontal synchronization signal are shortened. If humidity is low, the output intervals of the horizontal synchronization signal are lengthened.

According to each of the exemplary embodiments, the image data counter 311 analyzes the received image data on a line-by-line basis in the first scan direction, and counts the number of light-emitting elements 122 lit (turned on) on the LED print head 113 on a line-by-line basis. The count value is thus retrieved on a line-by-line basis. The present invention is not limited to this method. The image data counter 311 may count the number of light-emitting elements 122 on multiple lines at a time in the second scan direction, and the counted number may be handled as a count value.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image information retrieval unit that retrieves image information of an image to be formed on a recording material;

a density information retrieval unit that retrieves information relating to an image density of the image to be formed in accordance with the image information through analysis of the image information retrieved by the image information retrieval unit;

an exposure unit that exposes a rotating image carrier to light in response to the image information retrieved by the image information retrieval unit; and a setting unit that sets, in accordance with the information relating to the image density retrieved by the density information retrieval unit, an exposure period according to which the exposure unit exposes the rotating image carrier to light, wherein the setting unit sets the exposure period to be shorter if an image density retrieval unit is higher than a predetermined image density than if the image density is lower than the predetermined image density, wherein the information relating to the image density is the number of light-emitting elements to be lit when forming a line of image data on the recording material.

2. The image forming apparatus according to claim 1, further comprising:

a charging unit that is arranged upstream of the exposure unit in a rotation direction of the rotating image carrier and electrostatically charges the rotating image carrier to form a latent image;

a development unit that is arranged downstream of the exposure unit in the rotation direction of the rotating image carrier and develops a visible image in accordance with the latent image formed on the rotating image carrier by the exposure unit; and a transfer unit that transfers the visible image developed on the rotating image carrier by the development unit to a transfer member that transfers at a transfer section the visible image to the recording material or to an image on the recording material, wherein the setting unit sets the exposure period that accounts for information relating to a charge voltage at which the charging unit electrostatically charges the rotating image carrier and/or information relating to a transfer current supplied to the transfer section.

3. The image forming apparatus according to claim 2, further comprising a condition information retrieval unit that retrieves condition information relating to an internal condition within the image forming apparatus, wherein the setting unit sets the exposure period that accounts for the condition information retrieved by the condition information retrieval unit.

4. The image forming apparatus according to claim 3, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

5. The image forming apparatus according to claim 2, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

6. The image forming apparatus according to claim 1, further comprising:

a charging unit that is arranged upstream of the exposure unit in a rotation direction of the rotating image carrier and electrostatically charges the rotating image carrier to form a visible image;

a development unit that is arranged downstream of the exposure unit in the rotation direction of the rotating image carrier and develops a visible image in accordance with the latent image formed on the rotating image carrier by the exposure unit; and a transfer unit that transfers the visible image developed on the rotating image carrier by the development unit to a transfer member that transfers at a transfer section the visible image to the recording material or to an image on the recording material, wherein the setting unit sets the exposure period that accounts for information relating to a charge voltage at which the charging unit electrostatically charges the rotating image carrier and/or information relating to a transfer current supplied to the transfer section.

7. The image forming apparatus according to claim 6, further comprising a condition information retrieval unit that retrieves condition information relating to an internal condition within the image forming apparatus, wherein the setting unit sets the exposure period that accounts for the condition information retrieved by the condition information retrieval unit.

8. The image forming apparatus according to claim 7, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

9. The image forming apparatus according to claim 6, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

10. The image forming apparatus according to claim 1, further comprising a condition information retrieval unit that retrieves condition information relating to an internal condition within the image forming apparatus, wherein the setting unit sets the exposure period that accounts for the condition information retrieved by the condition information retrieval unit.

11. The image forming apparatus according to claim 10, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

12. The image forming apparatus according to claim 1, further comprising a condition information retrieval unit that retrieves condition information relating to an internal condition within the image forming apparatus, wherein the setting unit sets the exposure period that accounts for the condition information retrieved by the condition information retrieval unit.

13. The image forming apparatus according to claim 12, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

14. The image forming apparatus according to claim 1, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

15. The image forming apparatus according to claim 1, further comprising a width information retrieval unit that retrieves information relating to a width of the recording material to which the image formed on the rotating image carrier is transferred, wherein the density information retrieval unit retrieves the information relating to the image density through analysis of the image information that accounts for the information relating to the width of the recording material retrieved by the width information retrieval unit.

16. An image forming method comprising:

retrieving image information of an image to be formed on a recording material;

retrieving information relating to an image density of the image to be formed in accordance with the image information through analysis of the retrieved image information;

exposing an image carrier to light in response to the retrieved image information; and setting, in accordance with the information relating to the retrieved image density, an exposure period according to which the rotating image carrier is exposed to light, wherein the exposure period is set to be shorter if the retrieved information relating to the image density indicates file image density is higher than a predetermined image density than if the image density is lower than the predetermined image density, and wherein the information relating to the image density is the number of light-emitting elements to be lit when forming a line of image data on the recording material.

17. The image forming apparatus according to claim 1, wherein the density information retrieval unit analyses the image information on a line by line basis and sets the exposure period by adjusting a horizontal synchronization signal output by a horizontal signal generator.

* * * * *